US007495635B2

(12) United States Patent
Kim et al.

(10) Patent No.: US 7,495,635 B2
(45) Date of Patent: Feb. 24, 2009

(54) PLASMA DISPLAY DEVICE AND DRIVING METHOD FOR PLASMA DISPLAY PANEL

(75) Inventors: Jin-Sung Kim, Suwon-si (KR); Woo-Joon Chung, Suwon-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 563 days.

(21) Appl. No.: 10/992,646

(22) Filed: Nov. 22, 2004

(65) Prior Publication Data

US 2005/0110712 A1 May 26, 2005

(30) Foreign Application Priority Data

Nov. 26, 2003 (KR) ..... 10-2003-0084529

(51) Int. Cl.
*G09G 3/28* (2006.01)

(52) U.S. Cl. ..... 345/60; 345/63; 345/65; 345/68; 345/69

(58) Field of Classification Search ..... 345/60–69, 345/41, 42, 55, 72, 76, 78, 207, 204, 211; 315/169.1–169.4; 313/585, 485
See application file for complete search history.

(56) References Cited

U.S. PATENT DOCUMENTS 5,081,400 A * 1/1992 Weber et al. ..... 315/169.4
5,642,018 A * 6/1997 Marcotte ..... 315/169.4
5,835,072 A * 11/1998 Kanazawa ..... 345/60
6,011,355 A * 1/2000 Nagai ..... 315/169.3
6,087,779 A * 7/2000 Sakamoto et al. ..... 315/169.1
6,281,635 B1 * 8/2001 Lee ..... 315/169.4
6,897,834 B2 * 5/2005 McCormack ..... 345/55
6,956,331 B2 * 10/2005 Lee et al. ..... 315/169.1
7,023,139 B2 * 4/2006 Lee et al. ..... 315/169.1
7,123,219 B2 * 10/2006 Lee ..... 345/76
7,145,522 B2 * 12/2006 Yamamoto et al. ..... 345/60
2001/0028225 A1 * 10/2001 Awamoto ..... 315/169.1
2003/0071768 A1 * 4/2003 Park ..... 345/60
2003/0107532 A1 6/2003 Jeong Choi
2003/0193449 A1 * 10/2003 Wakabayashi et al. ..... 345/60
2004/0012546 A1 * 1/2004 Takagi et al. ..... 345/60
2004/0070350 A1 * 4/2004 Kwak et al. ..... 315/169.3
2004/0085263 A1 * 5/2004 Lee et al. ..... 345/41
2004/0104866 A1 * 6/2004 Sano et al. ..... 345/60
2004/0257304 A1 * 12/2004 Yamamoto et al. ..... 345/60
2005/0225255 A1 * 10/2005 Lee et al. ..... 315/169.4

(Continued)

FOREIGN PATENT DOCUMENTS

CN 1410959 4/2003

(Continued)

*Primary Examiner*—Prabodh M. Dharia
(74) *Attorney, Agent, or Firm*—H.C. Park & Associates, PLC

(57) ABSTRACT

Positive and negative sustain discharge voltages of equal magnitude are alternately applied to a scan electrode while biasing the sustain electrode at 0 V during a sustain interval. The positive sustain discharge voltage is applied through the first end of the scan electrode, and the negative sustain discharge voltage is applied through the second end of the scan electrode. The present invention may remove a brightness variation which may occur toward a direction the scanning electrode extends.

18 Claims, 8 Drawing Sheets

U.S. PATENT DOCUMENTS

2005/0231443 A1* 10/2005 Lee et al. ..... 345/60
2005/0259047 A1* 11/2005 Salters et al. ..... 345/67
2005/0270255 A1* 12/2005 Lee et al. ..... 345/68
2006/0187149 A1* 8/2006 Takagi et al. ..... 345/67
2006/0262045 A1* 11/2006 Park ..... 345/68
2007/0040766 A1* 2/2007 Lee ..... 345/66
2007/0091026 A1* 4/2007 Kwak ..... 345/68
2007/0097051 A1* 5/2007 Kang et al. ..... 345/89
2007/0109228 A1* 5/2007 Lee et al. ..... 345/68

FOREIGN PATENT DOCUMENTS

EP 1324302 7/2003

* cited by examiner

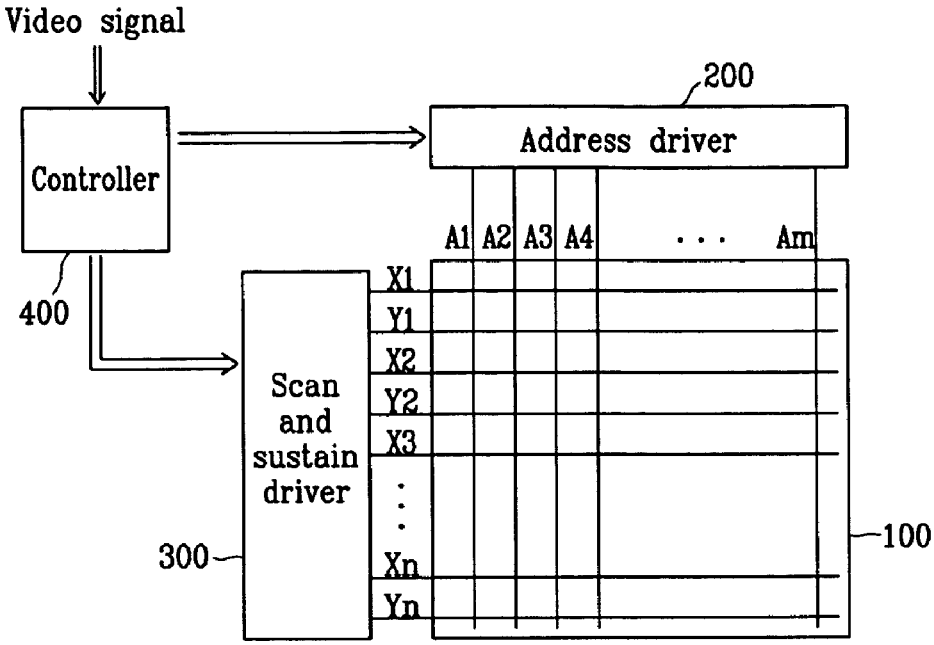
*FIG. 4*
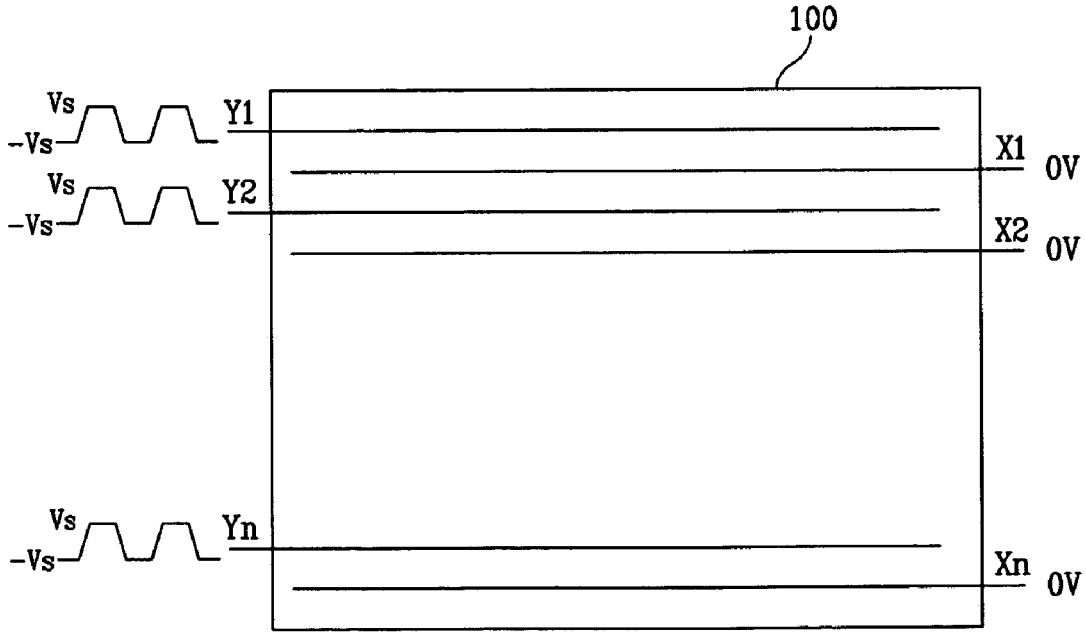

PLASMA DISPLAY DEVICE AND DRIVING METHOD FOR PLASMA DISPLAY PANEL

CROSS REFERENCE TO RELATED APPLICATION

This application claims priority to and the benefit of Korean Patent Application No. 10-2003-0084529, filed on Nov. 26, 2003, which is hereby incorporated by reference for all purposes as if fully set forth herein.

BACKGROUND OF THE INVENTION

1. Field of the Invention

This invention relates to a plasma display device and a driving method for a plasma display panel (PDP). More specifically, the present invention relates to a device and method for applying a sustain discharge waveform to a scan electrode and a sustain electrode during a sustain period.

2. Discussion of the Background

A plasma display device displays characters or images using plasma generated by gas discharge, and the PDP may have several thousands to several millions of pixels arranged in the matrix format, depending on its size.

FIG. 1 is a partial perspective view showing a typical PDP, and FIG. 2 shows a typical PDP electrode arrangement.

As shown in FIG. 1, parallel pairs of a scan electrode 4 and a sustain electrode 5 are arranged on a substrate 1 and covered with a dielectric layer 2 and a protective layer 3. A plurality of address electrodes 8, which are covered with a dielectric layer 7, are arranged on a substrate 6. Barrier ribs 9, which are formed on the dielectric layer 7, are formed in parallel to, and in between, the address electrodes 8. A fluorescent material 10 is formed on the dielectric layer 7 and sides of the barrier ribs 9. The substrates 1 and 6 are joined together with a discharge space 11 formed therebetween, so that the scan electrodes 4 and the sustain electrodes 5 lie in a direction substantially perpendicular to the address electrodes 8. A portion of the discharge space at an intersection between an address electrode 8 and a pair of a scan electrode 4 and a sustain electrode 5 forms a discharge cell 12.

As shown in FIG. 2, the PDP comprises a matrix of m×n pixels. In detail, address electrodes $A_1$ to $A_m$ are arranged in columns, and scan electrodes $Y_1$ to $Y_n$ and sustain electrodes $X_1$ to $X_n$ are alternately arranged in rows.

A driving method for such a PDP may include dividing an image frame into a plurality of subfields, each of which may comprise a reset period, an address period, and a sustain period. During the reset period, discharge cell states are initialized to stably perform a subsequent addressing operation. The address period is for selecting cells to be turned on and accumulating wall charges on those turned-on cells (i.e., addressed cells). The sustain period is for performing a discharge to display an image on the PDP.

During the sustain period, a sustain discharge pulse may be alternately applied to the scan and sustain electrodes, and during the reset and address periods, reset and scan waveforms may be applied to the scan electrode. Therefore, a typical sustain electrode driving circuit may output a sustain discharge waveform, but a typical scan electrode driving circuit may output reset, scan, and sustain discharge waveforms. Hence, a circuit for outputting the reset and scan waveforms may be added to the scan electrode driving circuit. Thus, a sustain discharge waveform output path in a scan electrode driving circuit may be longer than in a sustain electrode driving circuit. Further, more parasitic components may exist in the scan driver's output path as compared to the sustain driver's output path, which results in the output paths having different impedance. Consequently, applying sustain discharge waveforms to the scan and sustain electrodes using different sustain discharge paths with different impedances may problematically result in different light waveforms.

SUMMARY OF THE INVENTION

The present invention provides a PDP driving circuit wherein a sustain discharge waveform may be applied to one electrode of a scan electrode and a sustain electrode to have a uniform light waveform during the sustain period.

The present invention also provides a driving circuit that may prevent a brightness variation, due to a voltage drop along the electrode, from occurring on the display panel.

Additional features of the invention will be set forth in the description which follows, and in part will be apparent from the description, or may be learned by practice of the invention.

The present invention discloses a plasma display device comprising a plasma display panel including a plurality of first electrodes and a plurality of second electrodes, where a first electrode and a second electrode form a discharge cell. A first driver is coupled to a first end of the first electrode and applies a first voltage to the first end of the first electrode. A second driver is coupled to a second end of the first electrode and applies a second voltage to the second end of the first electrode. The first driver and the second driver alternately apply the first voltage and the second voltage to the first electrode, and the second electrode is biased at a third voltage during a sustain period.

The present invention also discloses a method for driving a PDP including a plurality of first electrodes and a plurality of second electrodes. The method comprises, in a sustain period, biasing a second electrode at a first voltage, applying a second voltage to a first electrode through a first end of the first electrode, and applying a third voltage to the first electrode through a second end of the first electrode. A voltage difference between the second voltage and the first voltage and a voltage difference between the first voltage and the third voltage cause a discharge between the first electrode and the second electrode.

The present invention also discloses a method for driving a PDP including a plurality of first electrodes and a plurality of second electrodes. The method comprises in a sustain period during which a second electrode is biased at a first voltage, increasing a voltage of a first electrode by making current flow in a first direction through the first electrode, applying a second voltage to the first electrode, decreasing a voltage of the first electrode by making current flow in the first direction through the first electrode, and applying a third voltage to the first electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 3 is a block diagram showing a plasma display device according to a first exemplary embodiment of the present invention.

FIG. 4 shows waveforms applied to the scan electrodes and the sustain electrodes during the sustain period of the plasma display device according to the first exemplary embodiment of the present invention.

DETAILED DESCRIPTION OF THE ILLUSTRATED EMBODIMENTS

Figure 1:
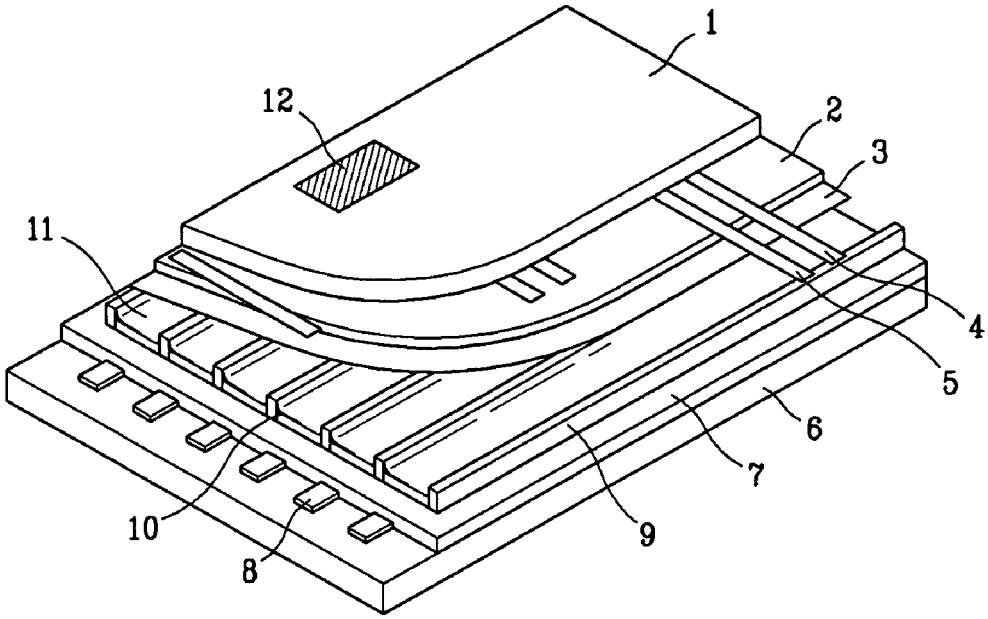
FIG. 1 (Prior Art)
FIG. 1 is a partial perspective view showing a conventional PDP.
Figure 2:
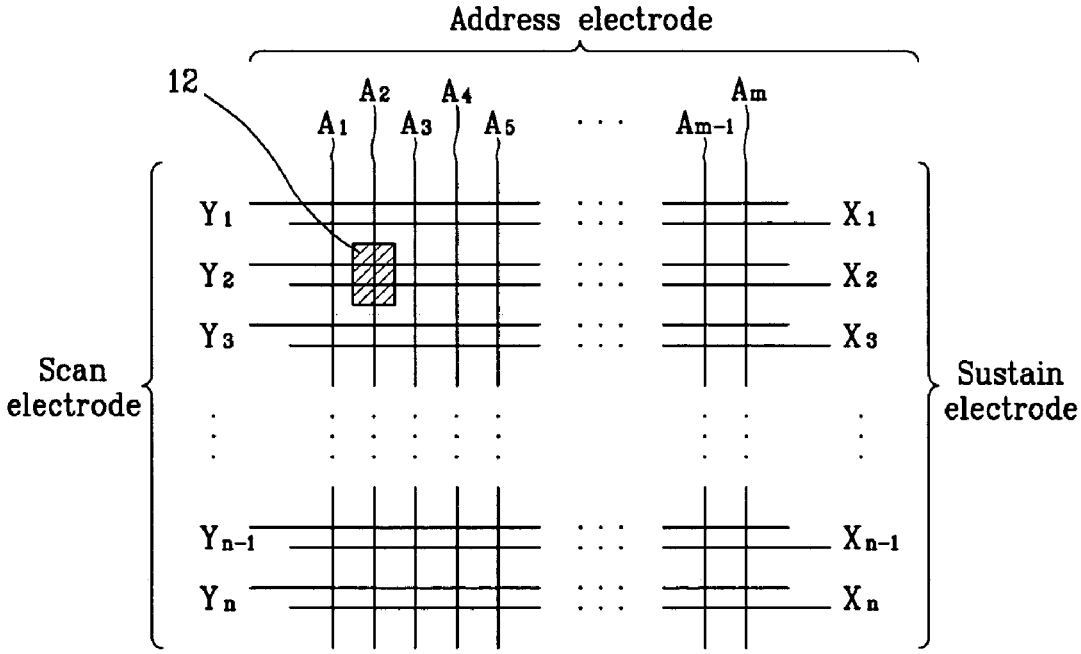
FIG. 2 (Prior Art)
FIG. 2 shows a typical electrode arrangement of the PDP of FIG. 1.

The following detailed description shows and describes exemplary embodiments of the present invention As will be realized, the invention is capable of modification in various obvious respects, all without departing from the invention. Accordingly, the drawings and description are to be regarded as illustrative in nature, and not restrictive.

In drawings, parts not related to the explanation are not shown for clear explanation. In the drawings, the same elements have the same reference signs. When it is explained that a part is coupled to another part or parts, the part or parts may be directly connected, or another element may be between them.

Hereinafter, a plasma display device and a PDP driving device and method are explained in detail referring to the drawings.

FIG. 3 is a diagram showing a plasma display device according to the first exemplary embodiment of the present invention, and FIG. 4 shows waveforms applied to scan and sustain electrodes during a sustain period of a plasma display device according to the first exemplary embodiment.

As shown in FIG. 3, the plasma display device comprises a PDP 100, an address driver 200, a scan and sustain driver 300, and a controller 400.

The PDP 100 includes a plurality of address electrodes $A_1$ to $A_m$ extended in a column direction and a plurality of pairs of scan (Y) electrodes $Y_1$ to $Y_n$ and sustain (X) electrodes $X_1$ to $X_n$ extended in a row direction. The controller 400 receives a video signal and generates and applies an address driving control signal and a sustain discharge control signal to the address driver 200 and the scan and sustain driver 300, respectively.

The address driver 200 receives the address driving control signal from the controller 400 and applies an address signal to the address electrodes $A_1$ to $A_m$ to select a discharge cell for display. The scan and sustain driver 300 receives the sustain discharge control signal from the controller 400 during the sustain period and applies a sustain discharge waveform alternating between voltages of Vs and −Vs to the Y electrodes $Y_1$ to $Y_n$, and biases the X electrodes at 0 V. Here, a sustain-discharge voltage Vs refers to a voltage that may generate a sustain discharge between the Y and X electrodes when combined with wall charges formed near the Y and X electrodes.

As shown in FIG. 4, a sustain-discharge waveform alternating between voltages of Vs and −Vs may be applied to Y electrodes during the sustain period while the X electrodes are biased at 0V. When the voltage Vs is applied to the Y electrode in a condition that a positive (+) wall charge and a negative (−) wall charge is formed, a sustain discharge occurs due to the voltage difference Vs between voltages applied to the Y and X electrodes and the wall voltage formed by the wall charges of the Y and X electrodes. Thus, a − wall charge and a + wall charge may form on the Y electrodes and the X electrodes, respectively. Next, when a voltage of −Vs is applied to the Y electrodes with a − wall charge and + wall charge formed on the Y and X electrodes, respectively, the sustain discharge occurs by a voltage difference −Vs between voltages applied to the Y and X electrodes and the wall voltage formed by the wall charges of the Y and X electrodes. Thus, a + wall charge and a − wall charge may form on the Y and X electrodes, respectively. When a voltage difference between voltages applied to the Y and X electrodes is Vs or −Vs, the voltages of Vs and −Vs may be applied to the Y electrodes only in order to make impedance consistent at all times.

Further, in the first exemplary embodiment as shown in FIG. 4, a sustain discharge waveform is applied to one side of a Y electrode and travels along the Y electrode in the row direction. Since a resistor element exists on the Y electrode, the voltage applied to the Y electrode drops as it progresses in the row direction, and the drop increases as the distance traveled along the Y electrode increases. Thus, an amount of light generated from a sustain discharge may decrease. As a result, a brightness variation in the row direction may occur in the panel. Further, since the Y and X electrodes work as a capacitive load, the voltage increase from −Vs to Vs, and the voltage decrease from Vs to −Vs, generate currents flowing in opposite directions, which may result in noise when the current direction changes.

Hereinafter, an exemplary embodiment that may solve these brightness variation and noise problems will be explained in detail referring to FIG. 5, FIG. 6, FIG. 7A, FIG. 7B. FIG. 7C and FIG. 7D.

Figure 5:
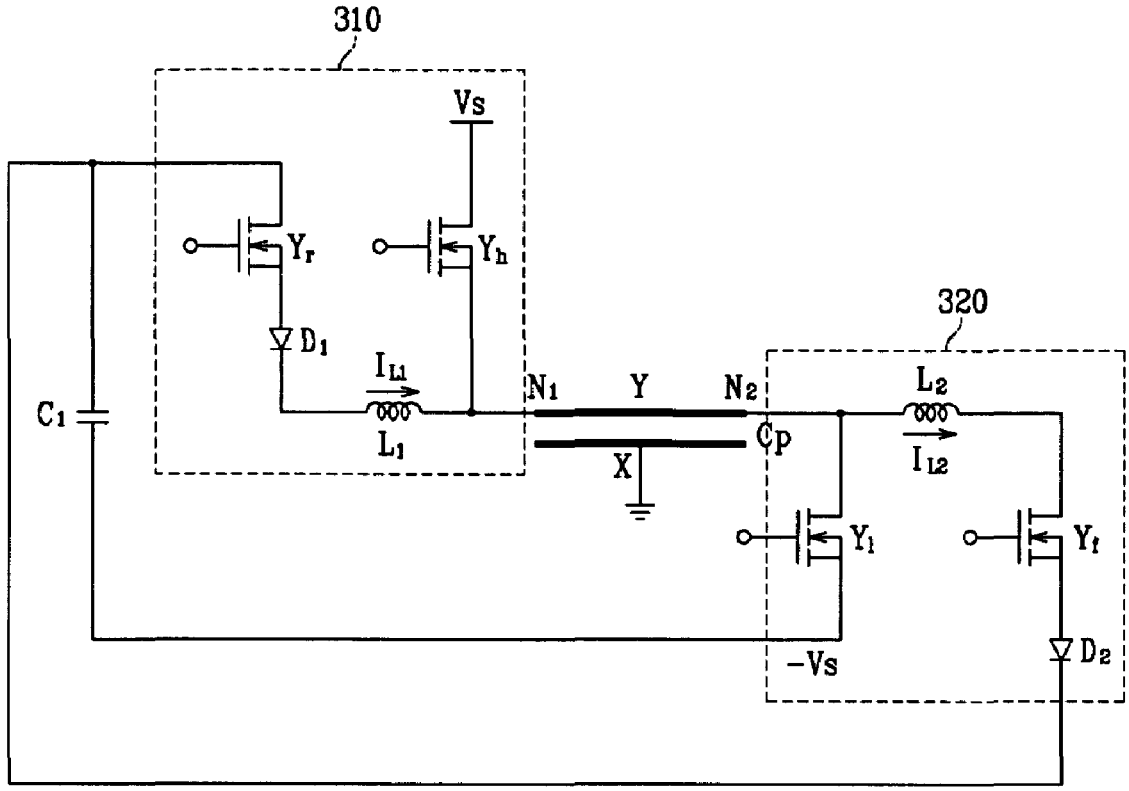
FIG. 5 shows a PDP driving circuit according to a second exemplary embodiment of the present invention.
Figure 6:
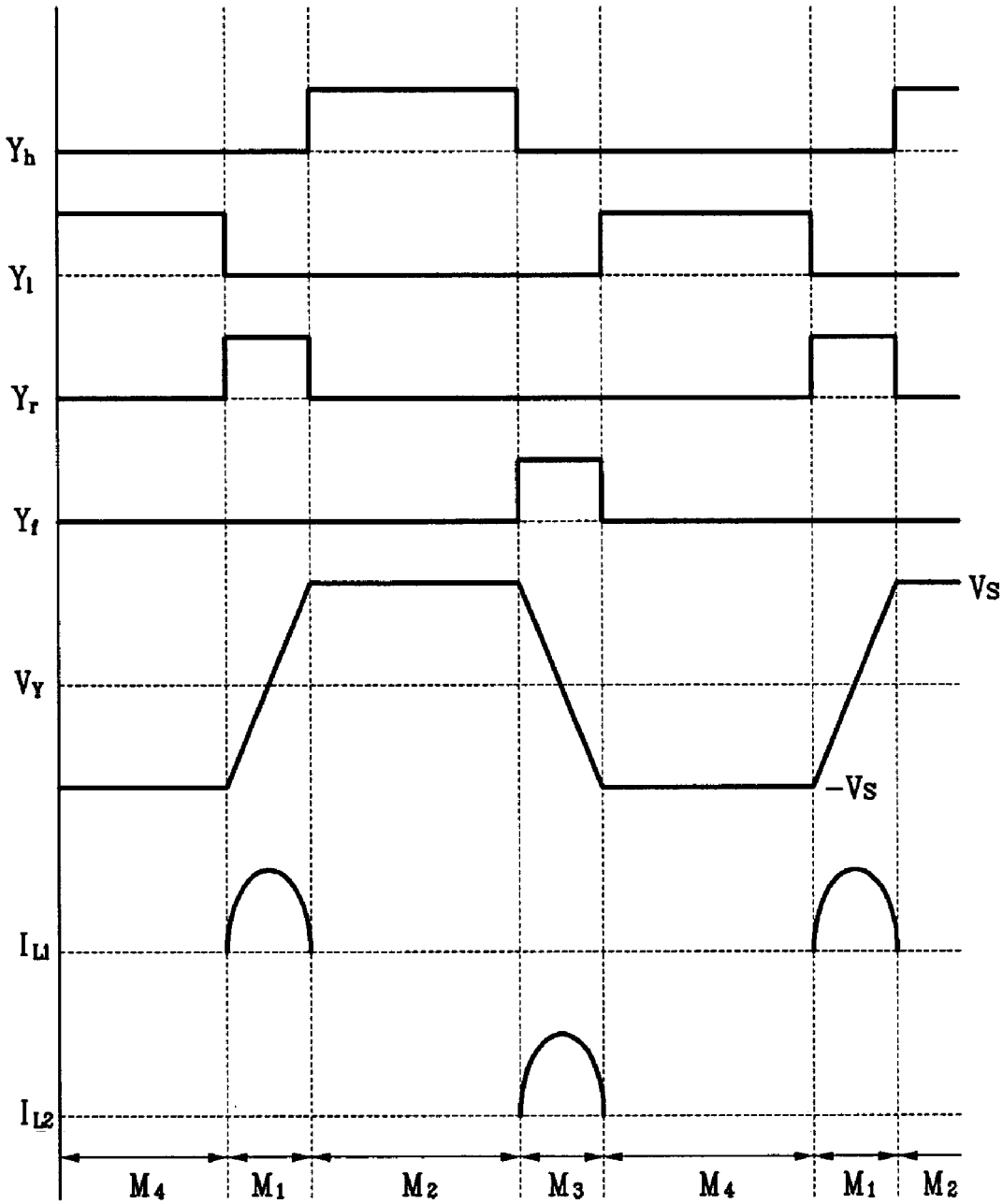
FIG. 6 is an operation-timing diagram of the driving circuit of FIG. 5.

FIG. 5 shows a PDP driving circuit according to the second exemplary embodiment of the present invention. FIG. 6 is an operation-timing diagram of the driving circuit of FIG. 5, and FIG. 7A, FIG. 7B, FIG. 7C, and FIG. 7D show current paths of each mode of operation of the driving circuit of FIG. 5.

As shown in FIG. 5, the PDP driving circuit according to the second exemplary embodiment comprises a first driver 310 coupled to the first end $N_1$ of a Y electrode, a second driver 320 coupled to the second end $N_2$ of the Y electrode, and a capacitor $C_1$. The X electrode may be biased at 0 V during the sustain period. A panel capacitor $C_p$ represents the Y and X electrodes, which may operate as a capacitive load when applying a sustain discharge waveform to them. The first driver 310 may include an inductor $L_1$ and transistors $Y_h$ and $Y_r$, and the second driver 320 may include an inductor $L_2$ and transistors $Y_1$ and $Y_f$. FIG. 5 shows the transistors $Y_h$, $Y_1$, $Y_r$, and $Y_f$ as n-channel field effect transistors having a body diode formed in a source to drain direction, but the invention is not limited thereto.

A drain of the transistor $Y_h$ may be coupled to a power source supplying a voltage Vs, and its source may be coupled to the first end $N_1$ of the Y electrode. A first end of the inductor $L_1$ may be coupled to the first end $N_1$ of the Y electrode, and a second end of the inductor $L_1$ may be coupled to a source of the transistor $Y_r$. A drain of the transistor $Y_r$ may be coupled to a first end of the capacitor $C_1$, and a second end of the capacitor $C_1$ may be coupled to a power source supplying a voltage of −Vs. Further, to prevent a current path formed by the body diode of the transistor $Y_r$, a diode D1 may be formed in a path including the first end of the capacitor $C_1$, the transistor Yr, and the inductor $L_1$.

A source of the transistor $Y_1$ may be coupled to the power source supplying the voltage of −Vs, and its drain may be coupled to the second end $N_2$ of the Y electrode. A first end of the inductor $L_2$ may be coupled to the second end $N_2$ of the Y electrode, and a second end of the inductor $L_2$ may be coupled to a drain of the transistor $Y_f$. A source of the transistor $Y_f$ may be coupled to the first end of the capacitor $C_1$. Further, to prevent a current path formed by the body diode of the transistor $Y_f$, a diode D2 may be formed in a path including the second end of the inductor $L_2$, the transistor $Y_f$, and the capacitor $C_1$.

Next, a temporal operation of the driving circuit of FIG. 5 will be explained referring to FIG. 6, FIG. 7A, FIG. 7B. FIG. 7C and FIG. 7D. The circuit has four sequential modes M1, M2, M3 and M4 of operation, which arise through manipulation of the circuit's switches. As noted above, when a sustain discharge waveform is applied, the Y electrode and the X electrode operate as capacitive loads, which is referred to as the panel capacitor Cp. Also, a resonance phenomenon may occur, but is not a continuous oscillation. Instead, it is a voltage and current variation caused by a combination of the inductor $L_1$ or $L_2$ and the panel capacitor Cp when the transistor $Y_r$ or $Y_f$ is turned on.

For purposes of the following description, it is assumed that before mode M1 begins, the transistor $Y_1$ is turned on, the Y electrode is maintained at the voltage of −Vs, and the voltage of Vs is charged in the capacitor $C_1$ of which the first end is at 0 V.

Figure 7A:
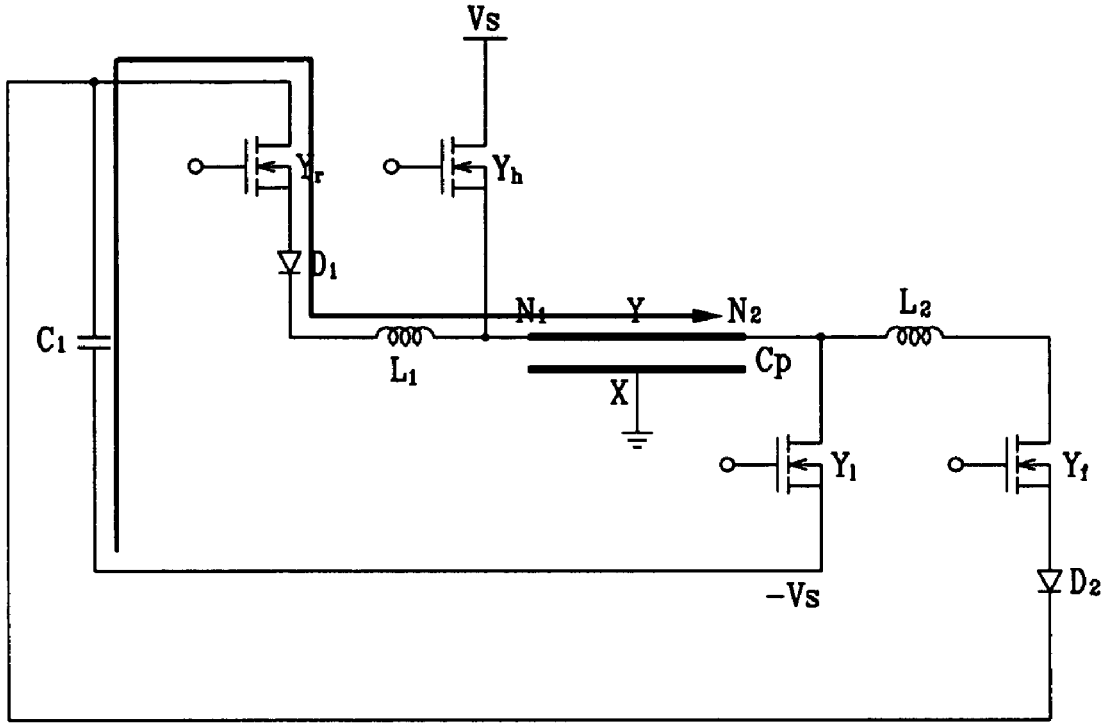
FIG. 7A, FIG. 7B, FIG. 7C and FIG. 7D show current paths for operational modes of the driving circuit of FIG. 5.

As shown in mode M1 of FIG. 6 and FIG. 7A, the transistor $Y_1$ is turned off, the transistor $Y_r$ is turned on, and resonance may occur between the inductor $L_1$ and the panel capacitor Cp through the capacitor $C_1$, the transistor $Y_r$, the inductor $L_1$ and the panel capacitor Cp. Resonance current $I_{L1}$ (shown in FIG. 5 and FIG. 6) flows from the inductor $L_1$ to the Y electrode by resonance, thereby increasing a voltage of the Y electrode. The voltage of the Y electrode may not actually increase to the voltage Vs because of a parasitic component of the driving circuit.

Figure 7B:
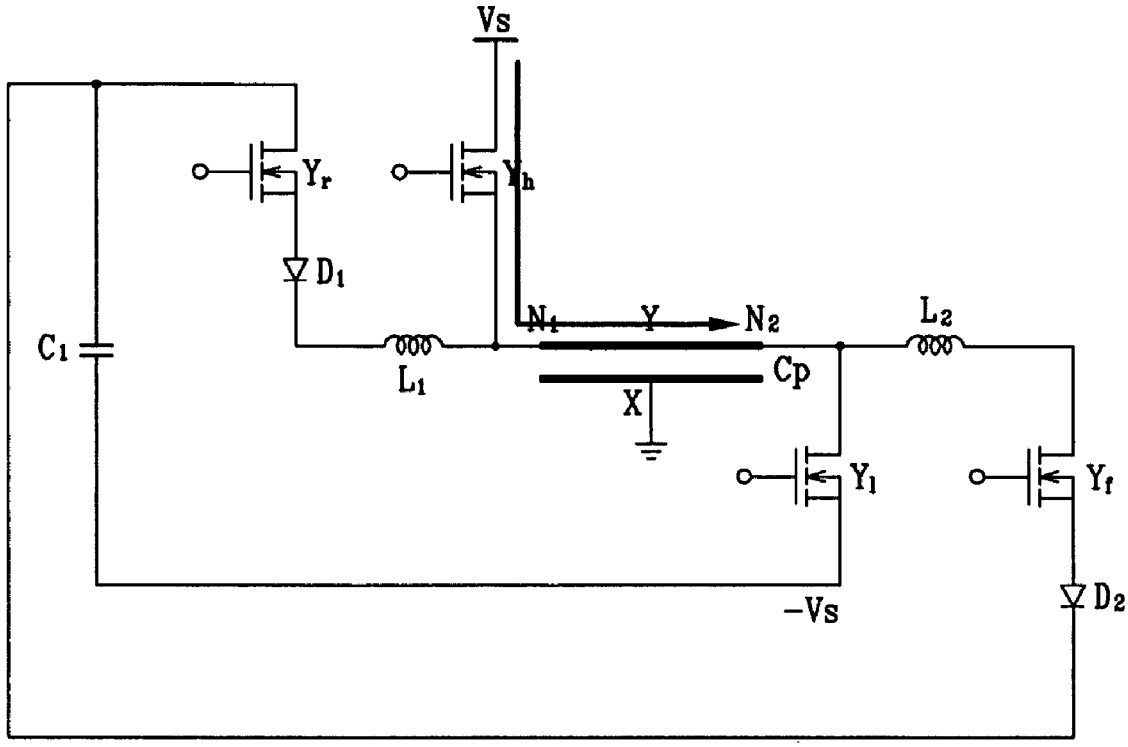
Figure 7C:
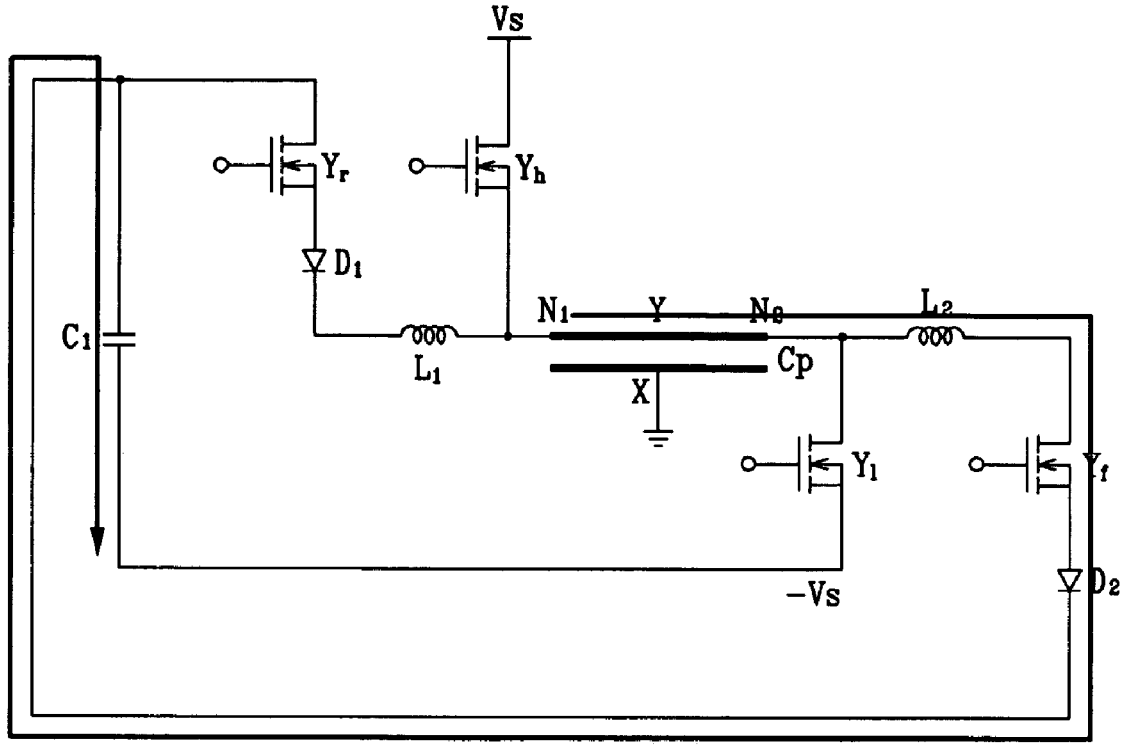
Figure 7D:
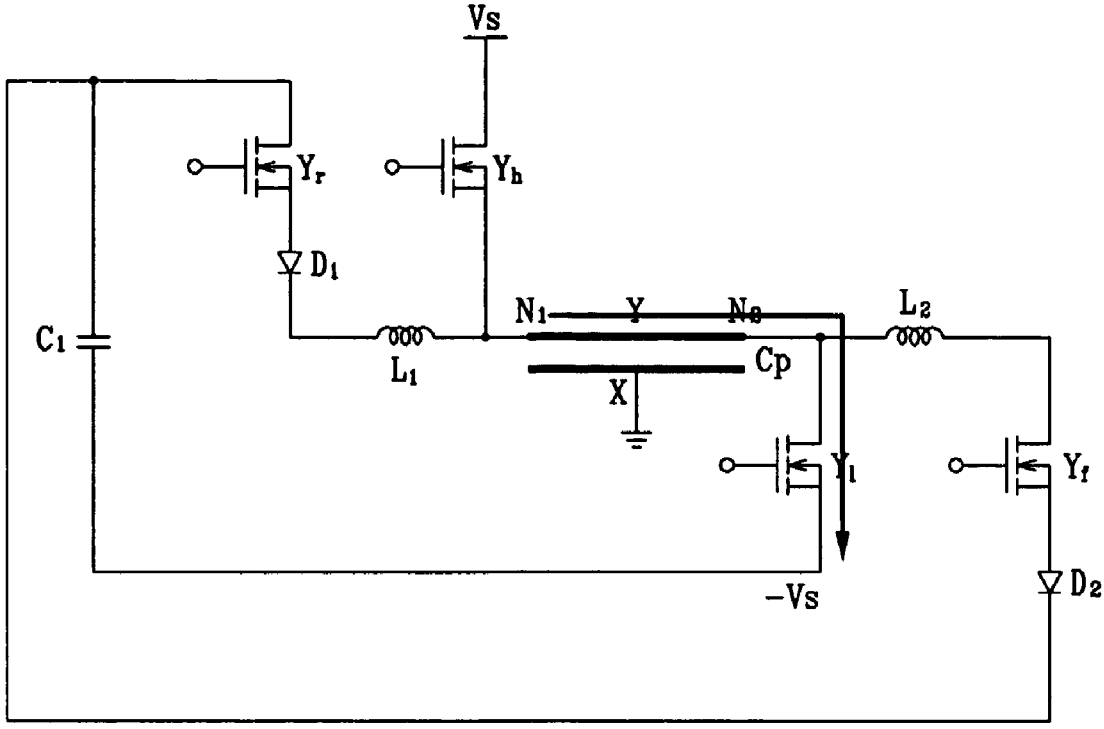

As shown in mode M2 of FIG. 6 and FIG. 7B, the transistor $Y_h$ is turned on when the voltage of the Y electrode approaches Vs, so that the voltage of Y electrode may reach Vs, and the transistor $Y_r$ is turned off.

As shown in mode M3 of FIG. 6 and FIG. 7C, the transistor $Y_h$ is turned off, the transistor $Y_f$ is turned on, and resonance may occur between the inductor $L_2$ and the panel capacitor Cp through the panel capacitor Cp, the inductor $L_2$, the transistor $Y_f$, and the capacitor C1. Resonance current $I_{L2}$ (shown in FIG. 5 and FIG. 6) flows from the panel capacitor Cp to the inductor L2 by resonance, thereby decreasing the voltage of the Y electrode. The voltage of the Y electrode may not actually decrease to the voltage −Vs because of a parasitic component of the driving circuit.

As shown in mode M4 of FIG. 6 and FIG. 7D, the transistor $Y_1$ may be turned on when the voltage of the Y electrode approaches −Vs, so that the voltage of the Y electrode may reach −Vs, and the transistor $Y_f$ is turned off.

As such, according to the secondary exemplary embodiment, a sustain discharge waveform may alternately apply voltages of Vs and −Vs to the Y electrode. The voltage of the Y electrode increases through its first end $N_1$ in mode M1, and the voltage Vs is applied to Y electrode through its first end $N_1$ in mode M2, thus the voltage applied to the Y electrode decreases in a direction from its first end $N_1$ to its second end $N_2$ in modes M1 and M2. Further, the voltage of the Y electrode decreases through its second end $N_2$ in mode M3, and the voltage −Vs is applied to the Y electrode through its second end $N_2$ in mode M4, thus the voltage applied to the Y electrode decreases in a direction from its second end $N_2$ to its first end $N_1$ in modes M3 and M4.

In other words, when applying the voltage Vs to the Y electrode for sustain discharge, a voltage drop occurs along the Y electrode from the first end $N_1$ to the second end $N_2$, thus a voltage difference between the Y and X electrodes decreases, which causes brightness to fall along the direction from the first end $N_1$ to the second end $N_2$. Further, when applying the voltage −Vs to the Y electrode for sustain discharge, a voltage drop occurs along the Y electrode from the second end $N_2$ to the first end $N_1$, thus a voltage difference between the Y and X electrodes decreases, which causes brightness to fall along the direction from the second end $N_2$ to the first end $N_1$. As such, applying voltages of Vs and −Vs to different ends of the Y electrode may provide for more uniform brightness across the PDP.

Further, as shown in FIGS. 7A and 7C, a resonance current that increases the voltage of the Y electrode flows from the first end $N_1$ to the second end $N_2$ of the Y electrode, and a resonance current that decreases the voltage of the Y electrode also flows from the first end $N_1$ to the second end $N_2$ of the Y electrode. Since the resonance current flows in the same direction whether increasing or decreasing the voltage of Y electrode, noise occurring due to a changing direction of an oscillation current may be eliminated.

As mentioned above, the first and second exemplary embodiments describe applying voltages of Vs and −Vs to the Y electrode while the X electrode is biased at 0V. However, the voltages of Vs and −Vs may be applied to the X electrode while the Y electrode is biased at 0 V. Further, a voltage of Vs+Vx and −Vs+Vx may be applied to the Y electrode while the X electrode is biased with the voltage Vx, which need not equal 0 V.

Further, the secondary exemplary embodiment describes that the second end of the capacitor $C_1$ is coupled to a power source −Vs, and the voltage Vs is charged in capacitor $C_1$. However, if the first end of the capacitor C1 supplies a voltage of 0V, another connection is possible. For example, another power source for supplying the voltage of 0V may be coupled to the drain of transistor $Y_r$ and the source of transistor $Y_f$, instead of the capacitor $C_1$.

As explained above, according to exemplary embodiments of the present invention, since a sustain discharge waveform is applied to the scan or sustain electrodes only, impedance may be consistently maintained. Further, since a high voltage is applied to one side of a scan electrode, and a low voltage is applied to the other side, a brightness variation, which may occur along a direction the scan electrode extends, may be decreased. And since a direction of oscillation current applied to the scan electrode during the sustain period does not change, noise occurring by changing the direction of the oscillation current is eliminated.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display device, comprising:

a plasma display panel including a plurality of first electrodes and a plurality of second electrodes, where a first electrode and a second electrode form a discharge cell, and the first electrode comprises a first end and a second end that is different from the first end;

a first driver coupled to the first end of the first electrode and for applying a first voltage to the first end of the first electrode; and a second driver coupled to the second end of the first electrode and for applying a second voltage to the second end of the first electrode, wherein during a sustain period, the first driver and the second driver alternately apply the first voltage and the second voltage to the first electrode, and the second electrode is biased at a third voltage.

2. The plasma display device of claim 1, wherein the first driver comprises a first inductor having a first end coupled to the first end of the first electrode, and applies the first voltage to the first electrode after changing a voltage of the first electrode from the second voltage through the first inductor; and wherein the second driver comprises a second inductor having a first end coupled to the second end of the first electrode, and applies the second voltage to the first electrode after changing a voltage of the first electrode from the first voltage through the second inductor.

3. The plasma display device of claim 2, wherein the first driver further comprises:

a first switch coupled between a second end of the first inductor and a first power source supplying a fourth voltage, and a second switch coupled between the first end of the first electrode and a second power source supplying the first voltage;

wherein the second driver further comprises:

a third switch coupled between a second end of the second inductor and the first power source, and a fourth switch coupled between the second end of the first electrode and a third power source supplying the second voltage;

wherein turning on the first switch changes a voltage of the first electrode, then turning on the second switch applies the first voltage to the first electrode, and turning on the third switch changes the voltage of the first electrode, then turning on the fourth switch applies the second voltage to the first electrode.

4. The plasma display device of claim 3, wherein the first power source is a capacitor having a first end coupled to the second end of the first inductor and the second end of the second inductor.

5. The plasma display device of claim 4, wherein a second end of the capacitor is coupled to the third power source.

6. The plasma display device of claim 3, wherein the first, second, third, and fourth switches are transistors having a body diode;

wherein the first driver further comprises a first diode formed in an opposite direction to the body diode of the first switch and on a path including the first end of the first electrode, the first inductor, the first switch, and the first power source; and wherein the second driver further comprises a second diode formed in an opposite direction to the body diode of the third switch and on a path including the second end of the first electrode, the second inductor, the third switch, and the first power source.

7. The plasma display device of claim 3, wherein the fourth voltage is substantially a middle voltage between the first voltage and the second voltage.

8. The plasma display device of claim 7, wherein the third voltage equals the fourth voltage.

9. The plasma display device of claim 1, wherein the third voltage is substantially a middle voltage between the first voltage and the second voltage.

10. The plasma display device of claim 9, wherein the third voltage is a ground voltage.

11. A method for driving a plasma display panel including a plurality of first electrodes and a plurality of second electrodes, a first electrode comprising a first end and a second end that is different from the first end, the method comprising:

in a sustain period, biasing a second electrode at a first voltage;

applying a second voltage to the first electrode through the first end of the first electrode; and applying a third voltage to the first electrode through the second end of the first electrode, wherein a voltage difference between the second voltage and the first voltage and a voltage difference between the first voltage and the third voltage cause discharge between the first electrode and the second electrode.

12. The method of claim 11, further comprising:

changing a voltage of the first electrode from the third voltage toward the second voltage through the first end of the first electrode before applying the second voltage to the first electrode; and changing a voltage of the first electrode from the second voltage toward the third voltage through the second end of the first electrode before applying the third voltage to the first electrode.

13. The method of claim 11, wherein a voltage of the first electrode is changed toward the second voltage through a first inductor coupled to the first end of the first electrode; and wherein a voltage of the first electrode is changed toward the third voltage through a second inductor coupled to the second end of the first electrode.

14. The method of claim 11, wherein the first voltage is substantially a middle voltage between the second voltage and the third voltage.

15. The method of claim 14, wherein the first voltage is a ground voltage.

16. A method for driving a plasma display panel including a plurality of first electrodes and a plurality of second electrodes, comprising:

in a sustain period during which a second electrode is biased at a first voltage, increasing a voltage of a first electrode by making a current flow in a first direction through the first electrode;

applying a second voltage to a first end of the first electrode;

decreasing a voltage of the first electrode by making a current flow in the first direction through the first electrode; and applying a third voltage to a second end of the first electrode, the second end being different from the first end.

17. The method of claim 16, wherein the first voltage is substantially a middle voltage between the second voltage and the third voltage.

18. The method of claim 17, wherein the first voltage is a ground voltage.

* * * * *